US012253263B2

(12) United States Patent
Chen et al.

(10) Patent No.: US 12,253,263 B2
(45) Date of Patent: Mar. 18, 2025

(54) FORCED CONVECTION OVEN WITH STEREO CIRCULATION

(71) Applicant: WHIRLPOOL CORPORATION, Benton Harbor, MI (US)

(72) Inventors: Jing Chen, Shenzhen (CN); Lin Ge, Shenzhen (CN); Tingting Yu, Shenzhen (CN)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 387 days.

(21) Appl. No.: 17/737,385

(22) Filed: May 5, 2022

(65) Prior Publication Data

US 2023/0358413 A1 Nov. 9, 2023

(51) Int. Cl.
*F24C 15/32* (2006.01)
*F24C 7/08* (2006.01)

(52) U.S. Cl.
CPC ..... *F24C 15/325* (2013.01); *F24C 7/085* (2013.01); *F24C 7/087* (2013.01)

(58) Field of Classification Search
CPC ..... F24C 7/087; F24C 7/067; F24C 15/325; F24C 7/085; H05B 6/6485
See application file for complete search history.

(56) References Cited

U.S. PATENT DOCUMENTS

| | | | | |
|---|---|---|---|---|
| 5,204,503 | A * | 4/1993 | Maiellano, Jr. | H05B 6/766 219/400 |
| 8,729,441 | B2 | 5/2014 | Kanzaki et al. | |
| 8,893,705 | B2 | 11/2014 | McFadden | |
| 11,076,604 | B2 | 8/2021 | Reese et al. | |
| 2002/0063126 | A1* | 5/2002 | Kim | H05B 6/6476 219/757 |
| 2006/0186108 | A1* | 8/2006 | Kim | F24C 7/06 219/400 |
| 2013/0004630 | A1 | 1/2013 | McFadden | |
| 2020/0080726 | A1* | 3/2020 | Polster | A47J 37/0629 |
| 2021/0307131 | A1* | 9/2021 | Heimerdinger | H05B 6/6473 |

FOREIGN PATENT DOCUMENTS

| | | | |
|---|---|---|---|
| DE | 60125894 | T2 | 5/2007 |
| JP | H590209 | U | 12/1993 |
| JP | 2002206748 | A | 7/2002 |
| WO | 2015101399 | A1 | 7/2015 |

* cited by examiner

*Primary Examiner* — Thien S Tran
(74) *Attorney, Agent, or Firm* — BROOKS KUSHMAN P.C.

(57) ABSTRACT

A convection oven is provided. An oven cavity is defined by at least by a top wall, a left side wall, a right side wall, and a door configured selectively open and close the oven cavity. An air channel defines a convection airflow out of and back into the oven cavity, the top wall defining an air inlet to allow the convection airflow to enter the air channel from the oven cavity, the walls further defining a plurality of outlets to allow the convection airflow to exit the air channel and reenter the oven cavity. Each of the plurality of outlets houses a corresponding one of a plurality of heating tubes, each corresponding heating tube being mounted along the convection airflow exiting the air channel.

15 Claims, 9 Drawing Sheets

FORCED CONVECTION OVEN WITH STEREO CIRCULATION

TECHNICAL FIELD

Aspects of the disclosure relate to ovens, and more particularly, to ovens that implement a forced convection oven with stereo circulation.

BACKGROUND

Conventional cooking appliances generally perform cooking operations through radiant heating developed from bake and/or broil elements. Such types of cooking appliances can take various forms, mainly ranges and wall ovens. While conventional or radiant heat cooking is suitable to a wide assortment of food types, the overall cooking process, especially baking, can be quite slow. The pre-heat time, combined with the cook time, is longer than most consumers desire.

Some radiant cooking appliances incorporate internal fans which can be used during cooking operations to generate an air flow within an oven cavity to enhance even cooking. Forced air convection allows for cooking at lower temperatures as compared to conventional radiant cooking processes. In addition, the forced air streams serve to disrupt a thermal insulation layer about the food item which increases the heat transfer rate between the food item and its surroundings, thereby reducing required cooking times.

In convection cooking appliances, the air flow can be designed to recirculate within the oven cavity, flow through the oven cavity and be exhausted, or a combination of both of these configurations. Some convection systems employ a fan at the rear of the oven cavity which draws cooking cavity air into a central intake portion and directs the air radially outward across a heating unit for re-introduction back into the oven cavity through plural, spaced exhaust outlets. Most often, the outlets are arranged either directly adjacent the side walls of the cooking cavity or the outlets are simply arranged in a generally circular configuration about the air inlet and angled toward the side walls. In either case, the air is exhausted along the side walls, flows forward towards a door for the oven cavity and then is re-directed into a central oven cavity region back to the fan intake.

However, such convection systems require significate space at the rear of oven, thus demanding significant depth being the oven cavity. In such systems, a large back compartment may be designed to contain the convection components, which makes the appearance look clumsy and dull. An example thickness of a typical rear convection apparatus design is on the order of 100-150 mm.

SUMMARY

In one or more illustrative embodiments, a convection oven is provided. An oven cavity is defined by at least by a top wall, a left side wall, a right side wall, and a door configured selectively open and close the oven cavity. An air channel defines a convection airflow out of and back into the oven cavity, the top wall defining an air inlet to allow the convection airflow to enter the air channel from the oven cavity, the walls further defining a plurality of outlets to allow the convection airflow to exit the air channel and reenter the oven cavity. Each of the plurality of outlets houses a corresponding one of a plurality of heating tubes, each corresponding heating tube being mounted along the airflow exiting the air channel.

In some embodiments, each of the plurality of outlets defines an elongate recess having a semi-annular surface, the recess extending into the air channel away from the oven cavity such that the recess is inset into the air channel, wherein the corresponding heating tube is axially mounted along the length of the recess.

In some embodiments, a lateral concave face of the recess defines a vent hole pattern, between the air channel and the recess, opening to the oven cavity. In some embodiments, side walls of the outlets define apertures through which the corresponding heating tube are mountable. In some embodiments, the semi-annular surface of the recess smoothly defects the airflow over and around the corresponding heating tube with a minimum of turbulence.

In some embodiments, the corresponding heating tube is a quartz tube heater, a halogen-radiation source heater, an IR-radiating heater, or a resistive element.

In some embodiments, the plurality of outlets includes a first outlet along the left side wall and a second outlet along the right side wall, thereby providing a stereo circulation pattern. In some embodiments, the plurality of outlets further includes a third outlet along a front portion of the top wall and a fourth outlet along a rear portion of the top wall. In some embodiments, the first outlet and the second outlet each extend from front to back of the oven cavity, and the third and fourth outlets each extend side to side along the oven cavity.

In some embodiments, the air inlet is located centrally in the top wall and a fan is located centrally and above the air inlet, such that when activated, the fan drives the airflow into the air channel via the air inlet and out of the air channel via the outlets.

In some embodiments, the convection oven further includes a controller configured to activate the fan and the plurality of heating tubes responsive to instruction to perform a cooking cycle; and deactivate the fan and the plurality of heating tubes responsive to completion of the cooking cycle.

In some embodiments, the convection oven further includes a plurality of sensors arranged throughout the oven cavity, wherein the controller is further configured to monitor temperature within the oven cavity using signals received from the plurality of sensors; responsive to determining that the temperature is too low adjacent to one or more of the heating tubes for the cooking cycle, power or increase power to those heating tubes, thereby increasing the temperature in that region of the convection oven; and responsive to determining that the temperature is too high adjacent to one or more of the heating tubes for the cooking cycle, remove power or decrease power to those heating tubes, thereby decreasing the temperature in that region of the convection oven.

In some embodiments, the plurality of sensors includes one or more of a camera sensor or an infrared sensor.

In some embodiments, the convection oven further includes a magnetron, wherein the controller is further configured to activate the magnetron in combination with the heating tubes responsive to instruction to perform a cooking cycle; and deactivate the magnetron responsive to completion of the cooking cycle.

In one or more illustrative embodiments, a method for utilizing a forced convection oven is provided. Monitoring temperature within an oven cavity is performed using signals received from a plurality of temperature sensors within the oven cavity, the oven cavity being defined by at least by a top wall, a left side wall, a right side wall, and a door configured selectively open and close the oven cavity, the convection oven including an air channel defining a convection airflow out of and back into the oven cavity, the top wall defining an air inlet to allow the convection airflow to enter the air channel from the oven cavity, the walls further defining a plurality of outlets to allow the convection airflow to exit the air channel and reenter the oven cavity, wherein each of the plurality of outlets houses a corresponding one of a plurality of heating tubes, each of the plurality of heating tubes being mounted along the convection airflow exiting the air channel, the air inlet being located centrally in the top wall, a fan being located centrally and above the air inlet, such that when activated, the fan drives the convection airflow into the air channel via the air inlet and out of the air channel via the outlets. Responsive to determining that the temperature is too low adjacent to one or more of the heating tubes for a cooking cycle, the controller powers or increases power to those heating tubes, thereby increasing the temperature in that region of the convection oven. Responsive to determining that the temperature is too high adjacent to one or more of the heating tubes for the cooking cycle, the controller removes power or decreases power to those heating tubes, thereby decreasing the temperature in that region of the convection oven.

In some embodiments, the convection oven receives an indication to begin the cooking cycle via input to user controls of the convection oven; activates the fan and the plurality of heating tubes responsive to instruction to perform the cooking cycle, and deactivates the fan and the plurality of heating tubes responsive to completion of the cooking cycle.

In some embodiments, the convection oven activates a magnetron in combination with the heating tubes responsive to instruction to perform a cooking cycle; and deactivates the magnetron responsive to completion of the cooking cycle.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

An improved forced convection system for an oven may be integrated into a chamber above and to the sides of the oven cavity, thereby avoiding the rear compartment in traditional forced convection systems. The system may include air inlets from different directions, including top front, top back, left, and right. The system may also include heating tubes or other heating elements at the top front, top back, left, and right inlet locations. Using the air inlets and heating tubes, the system may generate a stereo circulation of hot air inside the oven cavity. During operation, a working mode of the four heating tubes or other heating elements may be controlled individually and/or switched on/off at the same time to provide for even heat distribution in the oven cavity.

This improved oven may benefit from a more compact and space-saving design. The forced convection system may also decrease overall weight of the oven and may attract more customers by better performance. Additionally, the improved forced convection oven may increase the useful cavity capacity by reducing the back compartment size. Better performance may also be provided for functions such as of forced convection or air fry, due to the improved like airflow speed and heating capacity. Further aspects of the improved system are discussed in detail herein.

Figure 1:
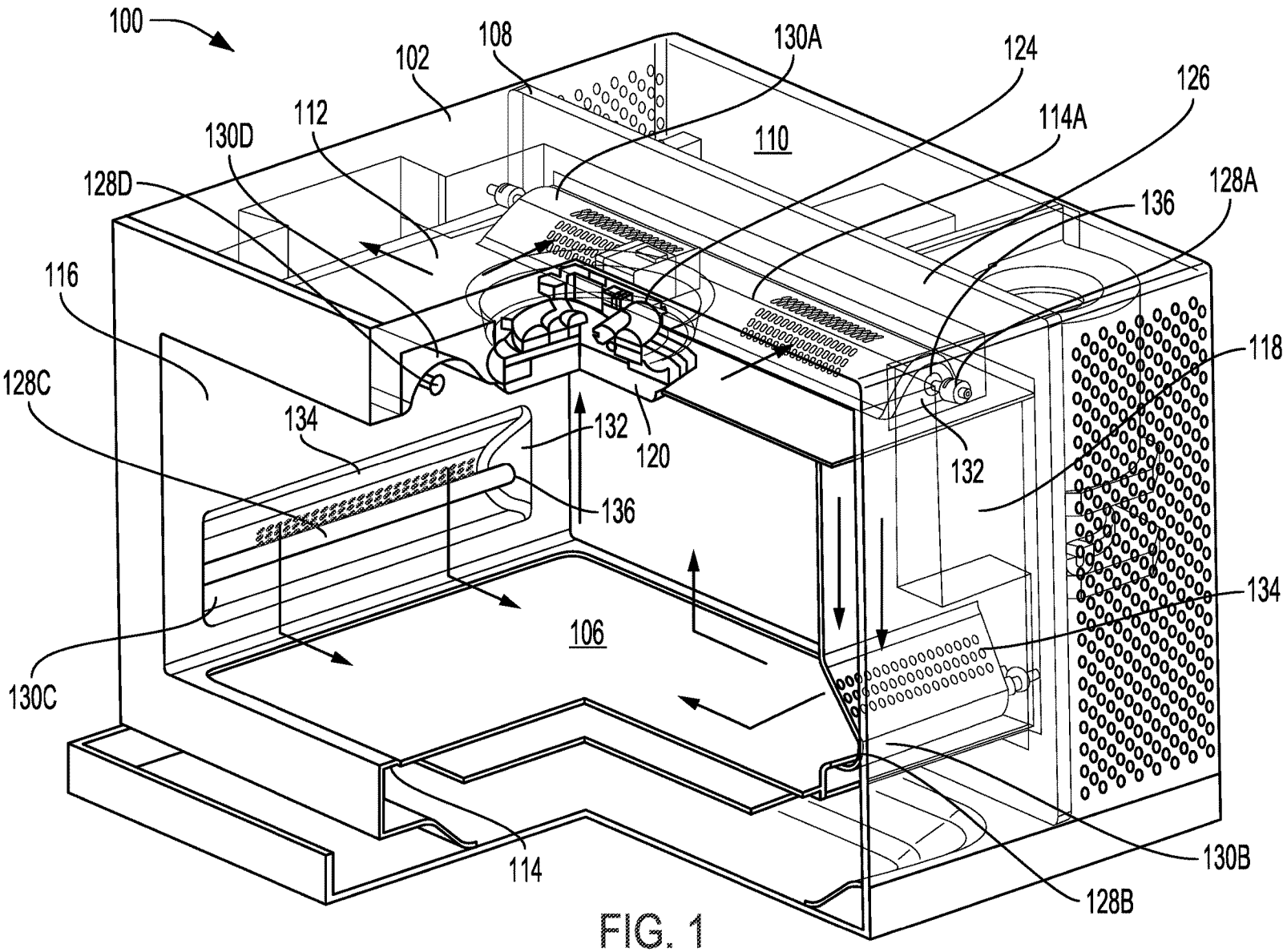
FIG. 1 illustrates an example convection oven including an improved stereo convection circulation system in an embodiment of the disclosure.

FIG. 1 illustrates an example convection oven 100 including an improved stereo convection circulation system. The oven 100 may be of various types, such as a conventional oven, a microwave oven, or a combination microwave oven. As illustrated, the oven 100 generally has a housing 102 having a top, bottom, sides, and a rear that define a main chamber. The main chamber is divided into an oven cavity 106 in front of a separator plate 108 and a rear electronics chamber 110 behind the separator plate 108. The separator plate 108 generally extends the width and height of the oven 100 between the left, right, top, and bottom inner walls of the housing 102. The rear electronics chamber 110 is accordingly defined by the separator plate 108 at the front, and by the side, back, top, and bottom walls of the housing 102.

The oven cavity 106 is defined at the rear by the separator plate 108 which is shared as the front wall of the rear electronics chamber 110, as well as by a top wall 112, a bottom wall 114, a left side wall 116 and a right side wall 118. The separator plate 108 and/or walls 112, 114, 116, 118 may be formed of sheet metal, plastic, or another suitable material. The oven 100 also includes a door 104 at the front of the oven cavity 106, to selectively open and close the oven cavity 106.

The top wall 112 may be offset below the top of the housing 102, and the left side wall 116 and right side wall 118 may also be offset internally from the corresponding walls of the housing 102 to collectively define a U-shaped compartment around the top and sides of the oven cavity 106.

An air channel 126 may be provided within the U-shaped compartment to contain a convection air flow out of and back into the oven cavity 106. The top wall 112 may define an air inlet 120 to allow airflow to enter the air channel 126 from the oven cavity 106. In an example, the air inlet 120 may define a vent hole pattern, such as a circular or other arrangement of a pattern of through holes, an inlet grille, louvers, etc.

One or more outlets 130 may also be defined to allow airflow to exit the air channel 126 and reenter the oven cavity 106. In the illustrated example: a first outlet 130A may be provided at a top rear of the oven cavity 106, a second outlet 130B may be provided at a top front of the oven cavity 106, a third outlet 130C may be provided at a left side of the oven cavity 106, and a fourth outlet 130D may be provided at a right side of the oven cavity 106.

Each of the outlets 130 may define an elongate semi-annular recess extending into the air channel 126 away from the oven cavity 106. The outlets 130 may extend from a quadratic opening to the oven cavity 106 and may form a semicircular profile into the cavity wall. The outlets 130 may additionally define side outlet walls 132 between the opening of the outlet 130 to the oven cavity 106 and the profile of the recess of the outlets 130. The side outlet walls 132 may be substantially parallel to one another, in an example.

The lateral concave face of the recess may define a vent hole pattern 134, such as a pattern of through holes between the air channel 126 and the recess opening to the oven cavity 106. As shown, the vent hole pattern 134 includes three rows of equally spaced and sizes holes along the length of the air channels 126, but this is only one example.

The chambers defined by the outlets 130 may be configured to facilitate the axial mounting of heating tubes 128 along the length of the recess, such that the heating tubes 128 may be mounted fully outside the generally rectangular prism of the oven cavity 106. For instance, the side outlet walls 132 may include apertures 136 through which the heating tubes 128 may be inserted and held into place. As shown, the heating tubes 128 are generally cylindrical, and the apertures 136 are generally circular and sized to the diameter of the heating tubes 128. However, for differently shaped heating tubes 128 the apertures 136 may be of a different corresponding profile. As some examples, the heating tubes 128 may be quartz tube heaters, a halogen-radiation source heaters, IR-radiating heaters, resistive elements, etc. The heating tubes 128 may be selectively heated to varying heat levels based on internal temperature readings. This is described in more detail below.

Figure 2:
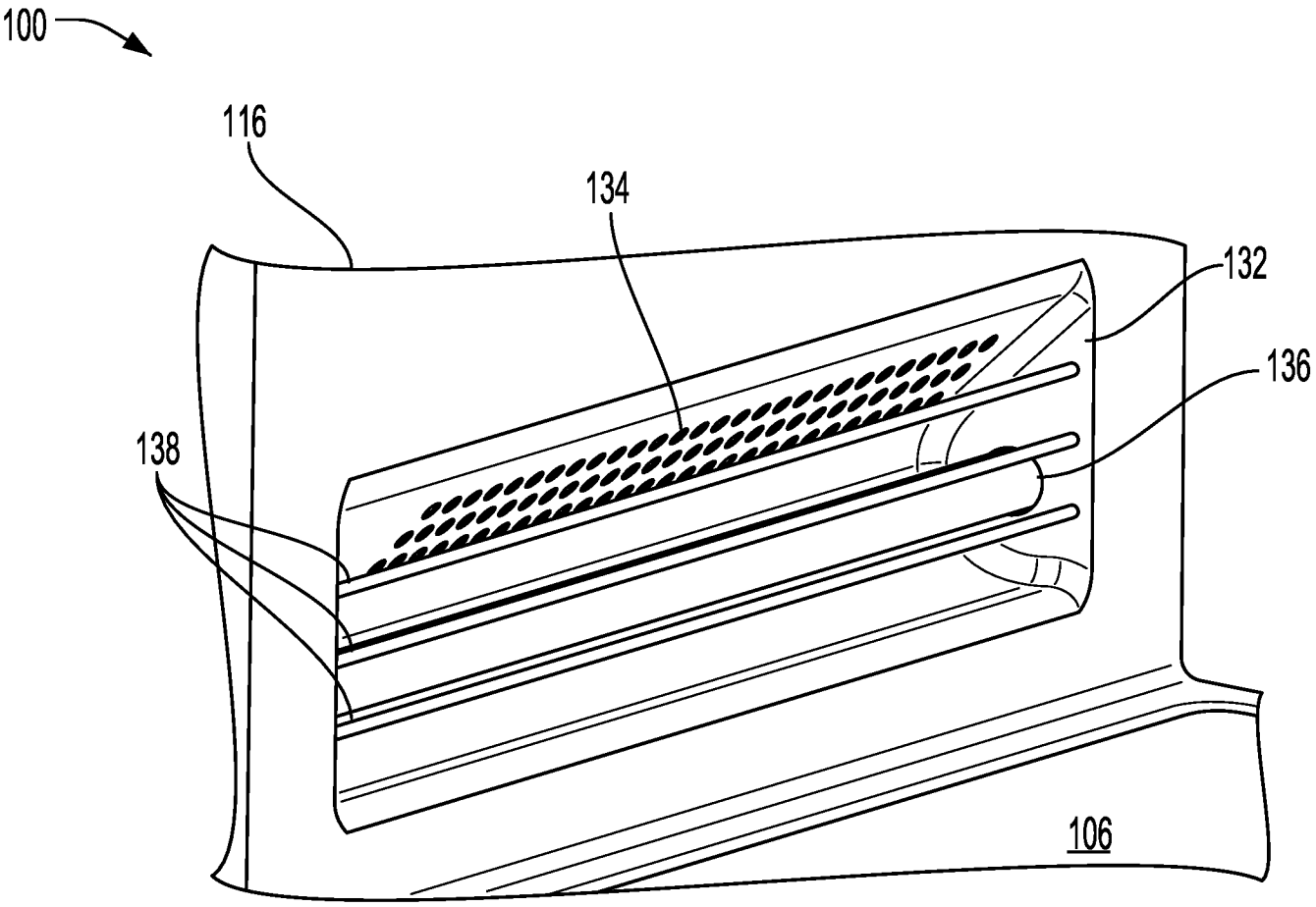
FIG. 2 illustrates a perspective view of one of the side outlets in an embodiment of the disclosure.

FIG. 2 illustrates a perspective view of one of the side outlets 130. As shown in FIG. 2, the outlet 130 may include a guard 138 to protect the heating tube 128 from coming into contact with food or other items that may be within the oven cavity 106. The illustrated guard 138 includes a series of elements extending along the width of the semicircular profile of the outlet 130, but this is only an example, and other designs of guards 138 between the heating tube 128 and the oven cavity 106 may be utilized.

Referring back to FIG. 1, each of a plurality of heating tubes 128A-D may be located in a respective outlet 130 of the air channel 126 into the oven cavity 106. As shown, heating tube 128A is provided in a first outlet 130A, heating tube 128B is provided in a second outlet 130B, heating tube 128C is provided in a third outlet 130C, and heating tube 128D is provided in a fourth outlet 130D.

As the recesses are inset into the air channel 126, the airflow may pass through the vent hole pattern 134 and come into contact with the heating tubes 128 in a generally unobstructed flow pattern with a minimum of bends. Additionally, the annular surface of the recesses may serve to smoothly defect the airflow over and around the heating tubes 128 with a minimum of turbulence.

A fan 124 may be provided in the upper portion of the air channel 126. In an example, air inlet 120 may be located centrally in the top wall 112 and the fan 124 may also be located centrally and above the air inlet 120. When activated, the fan 124 may be configured to drive airflow into the air channel 126 via the air inlet 120 and out of the air channel 126 via the outlets 130.

Figure 3:
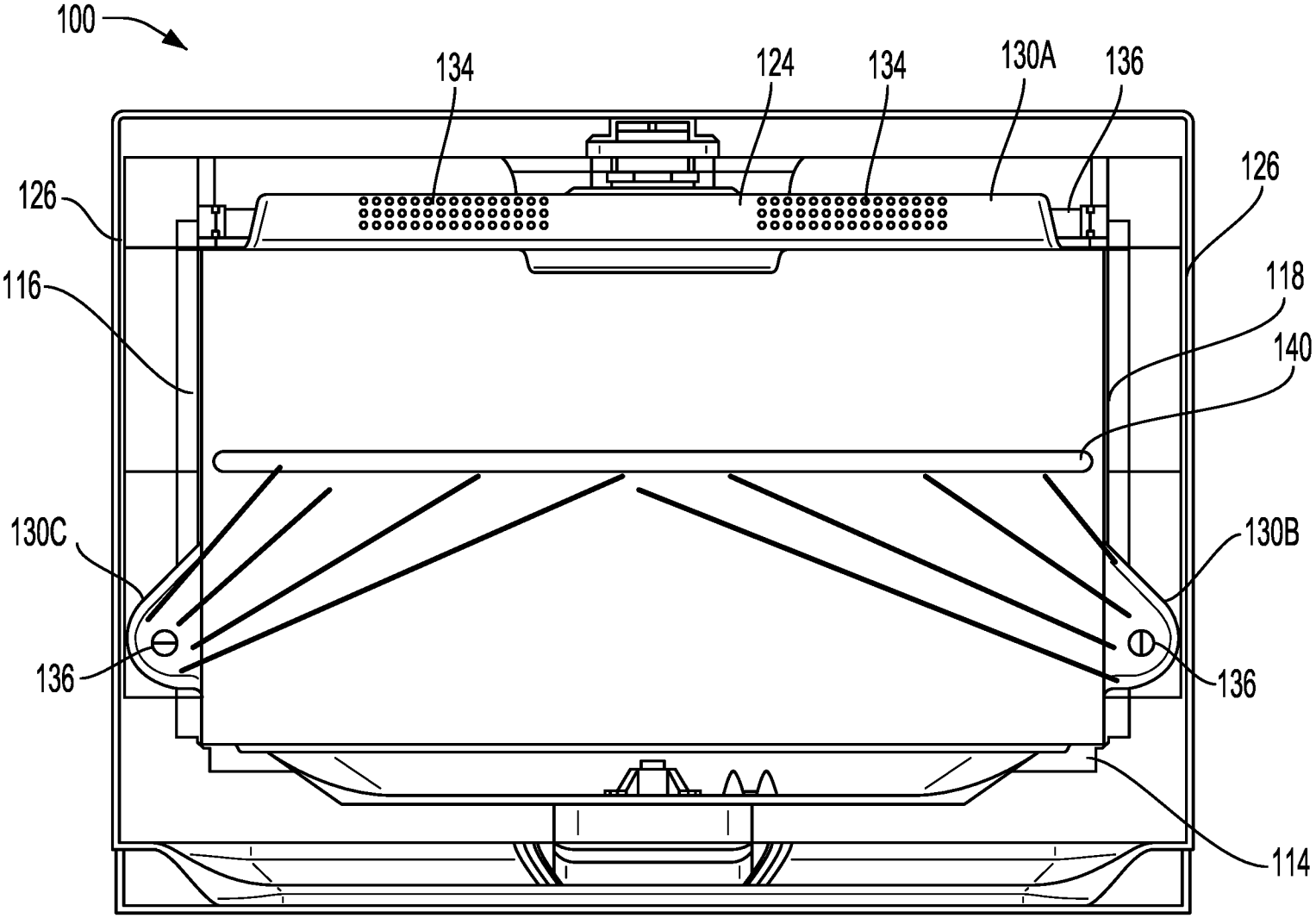
FIG. 3 illustrates a front cutaway view of operation of the lower heating tubes of the convection oven in an embodiment of the disclosure.
Figure 4:
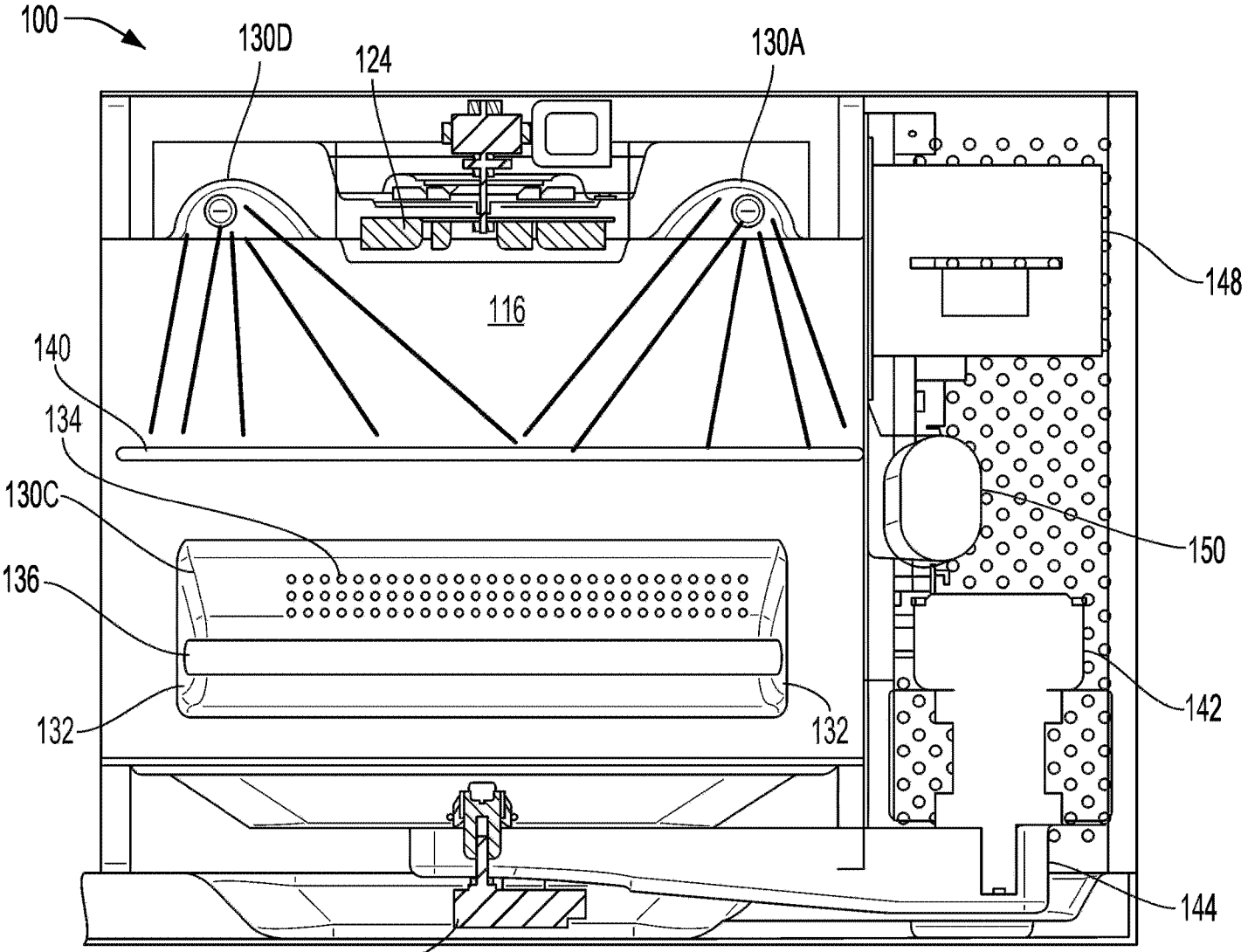
FIG. 4 illustrates a front cutaway view of operation of the upper heating tubes of the convection oven in an embodiment of the disclosure.

FIG. 3 illustrates a front cutaway view of operation of the lower heating tubes 128B and 128C of the convection oven 100. As shown, the operation of the lower heating tubes 128 may be used to provide heating from below to food items placed on a rack 140 within the oven cavity 106. FIG. 4 illustrates a front cutaway view of operation of the upper heating tubes 128A and 128D of the convection oven 100. As shown, the operation of the upper heating tubes 128 may be used to provide heating from above to food items placed on the rack 140.

The convection oven 100 may also include a microwave cooking system in addition to the heating tube 128 heating system. During operation, microwave energy travels from a magnetron 142 through a waveguide 144 and is distributed into the oven cavity 106 via a mode stirrer 146. The microwave energy transfers to the food via dielectric heating. Once the food is heated, the magnetron 142 is deactivated, the door 104 is reopened, and the food is removed. The oven 100 may also include a door switch (not shown) that detects whether the door 104 is open or closed, such that the magnetron 142 is automatically deactivated should the door 104 be opened during a cooking cycle.

Figure 5:
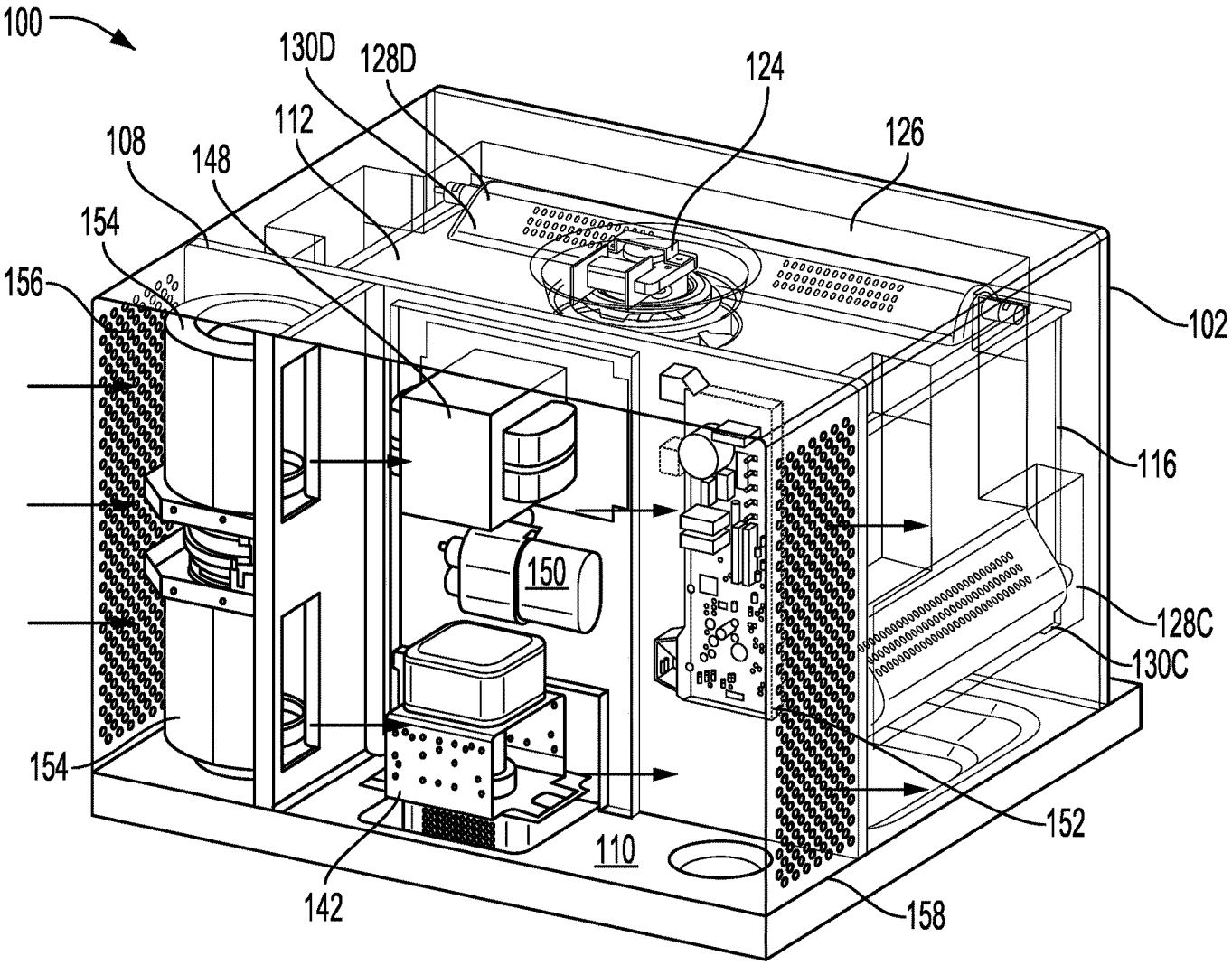
FIG. 5 illustrates an example rear perspective view of the convection oven showing an electronics airflow in an embodiment of the disclosure.

The magnetron 142 may be driven by electrical components that provide a high voltage source, such as a transformer 148 and capacitor 150 as shown (in other examples a switching power supply may be used). The oven 100 may also include an electronics board 152 to control the operation of the other components of the oven 100. During operation of the oven 100, these electrical components of the oven 100 (e.g., the magnetron 142, transformer 148, capacitor 150, and electronics board 152) produce waste heat. To remove this heat, the oven 100 may include one or more rear fans 154 driving an air flow in from a rear air intake 156 located in this example on the rear of the right wall of the housing 102, across the rear electronics chamber 110 to draw this heat away from the electrical components, to be exhausted out a rear air outlet 158 located on the rear of the left wall of the housing 102. This electronics air flow is best illustrated in FIG. 5.

Figure 6:
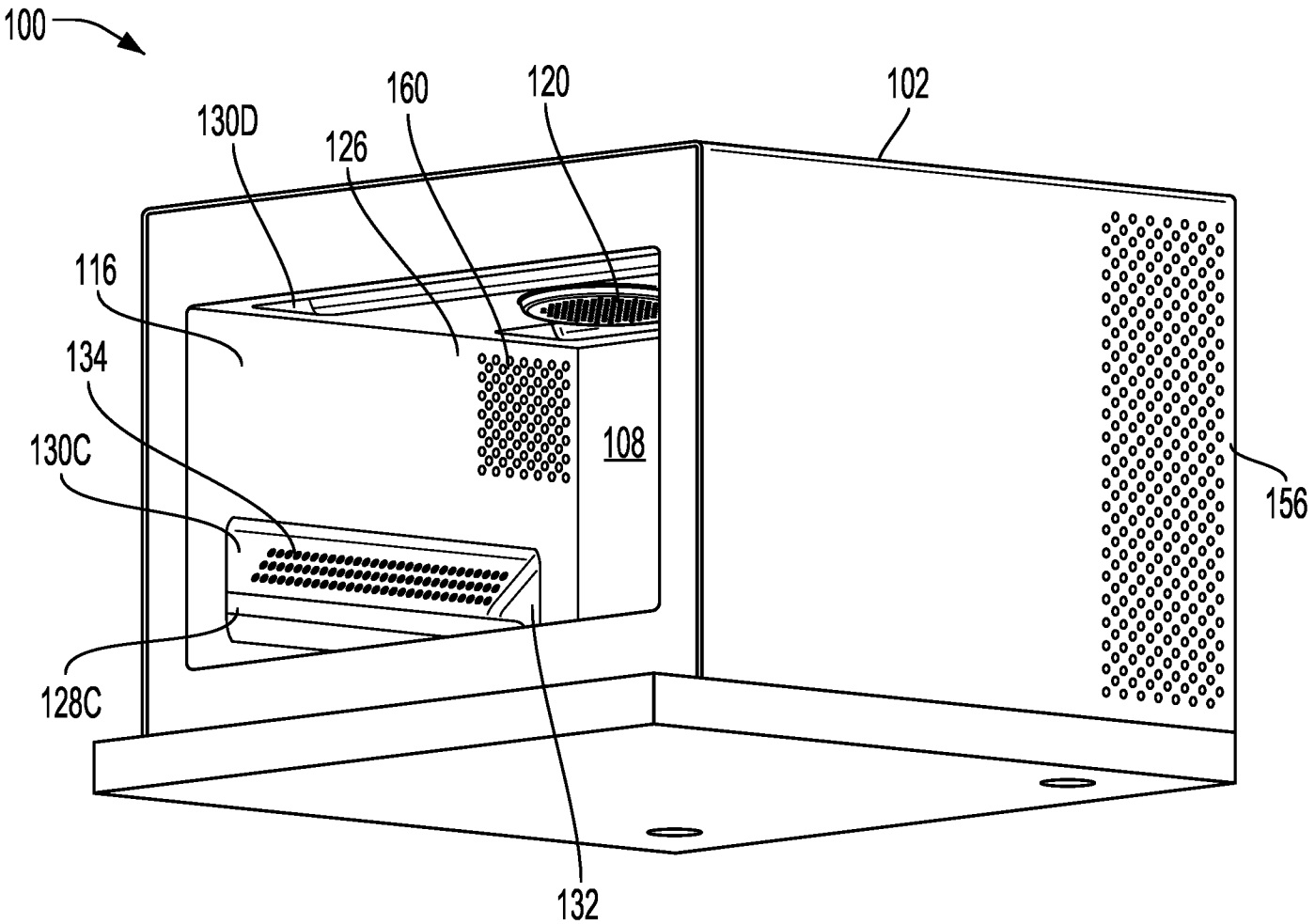
FIG. 6 illustrates an example front perspective view of the convection oven showing an oven cavity outlet in an embodiment of the disclosure.

Additionally, because the magnetron 142 of the oven 100 operates by heating water molecules, the cooking process tends to generate steam. This steam may condense on the cooler inside surfaces of the oven cavity 106. This condensation may be more prevalent when cooking foods of high moisture content for extended periods of time. In these instances, the condensation may be especially noticeable to the user. Thus, in some examples, an oven cavity outlet 160 may be defined in the oven cavity 106 to allow for an exhaust of humid air. As shown in FIG. 6, the oven cavity outlet 160 is defined by upper rear of the left side wall 116, outside of the air channel 126 defined to carry the convection air flow out of and back into the oven cavity 106.

Figure 7:
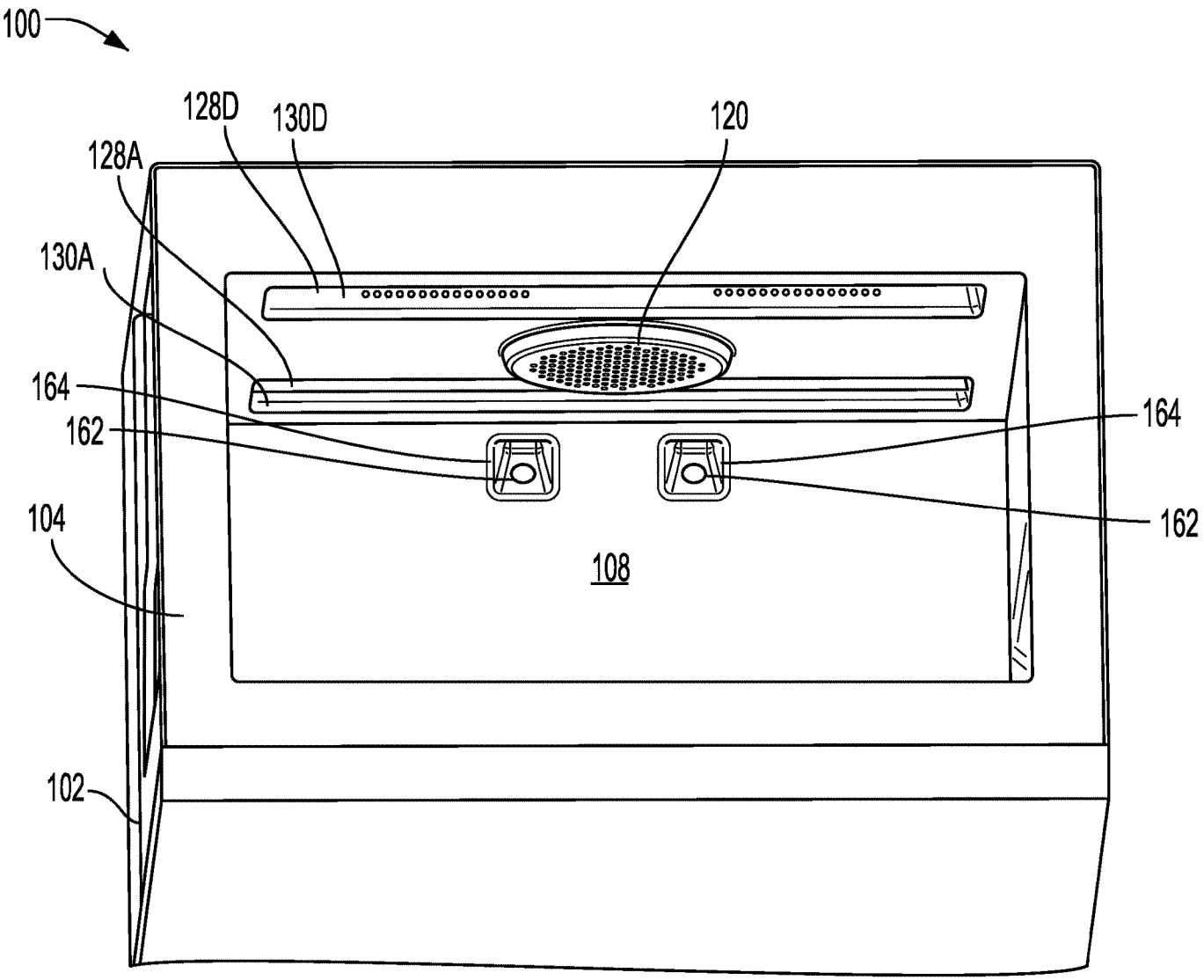
FIG. 7 illustrates an example front perspective view of the convection oven showing an infrared sensor and a camera sensor in an embodiment of the disclosure.

FIG. 7 illustrates an example of placement of sensors 162 within the oven cavity 106. In the illustrated example, two sensors 162 are placed at the top of the separator plate 108. For example, the separator plate 108 may define sensor housings 164 to hold the sensors 162, which may include camera sensors 162, infrared (IR) sensors 162, humidity sensors 162, or other sensors 162 useful for determine the temperature, doneness, or other aspects of the oven cavity 106 and/or food items placed into the oven cavity 106. In an example, the sensor housings 164 may be integrated into the separator plate 108 and may define protrusions into the oven cavity 106 into which the sensors 162 may be held outside of the environment of the oven cavity 106 itself at an angle into the oven cavity 106 providing a good view of the oven cavity 106.

Figure 8:
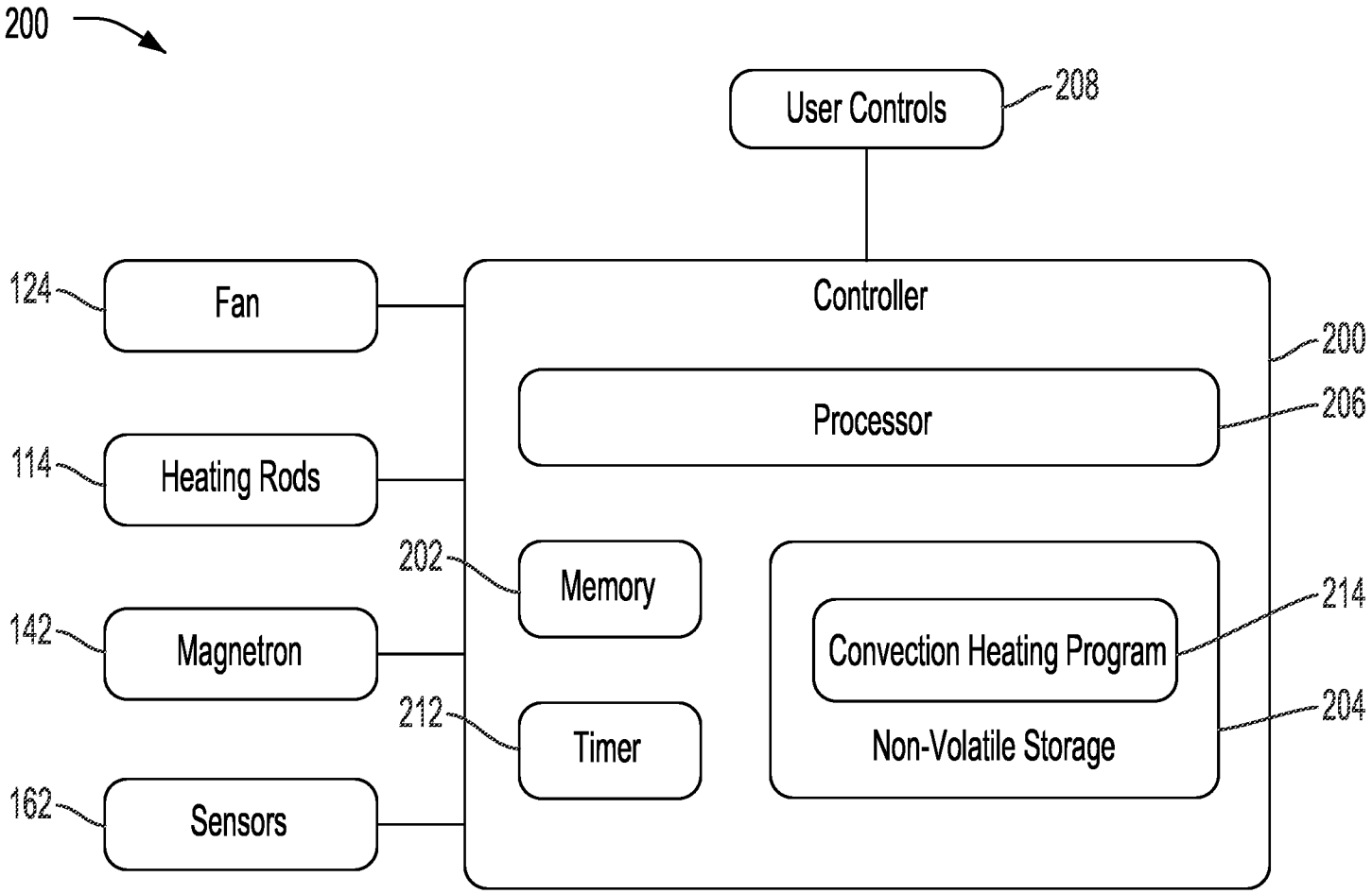
FIG. 8 illustrates an example controller configured to operate the components of the oven.

FIG. 8 illustrates an example controller 200 configured to operate the components of the oven 100. In an example, the controller 200 may operate the oven 100 to perform cooking cycles to prepare food items placed in the oven cavity 106. The controller 200 may include a memory 202, a non-volatile storage 204, a processor 206, and a timer 212. The non-volatile storage 204 may store operations for a convection heating program 214 configured to allow the oven 100 to control the fan 124 and heating tubes 128 to perform the cooking cycles.

The memory 202 may include a single memory device or a number of memory devices including, but not limited to, random access memory (RAM), volatile memory, non-volatile memory, static random access memory (SRAM), dynamic random access memory (DRAM), flash memory, cache memory, or any other device capable of storing information. The non-volatile storage 204 may include one or more persistent data storage devices such as a hard drive, optical drive, tape drive, non-volatile solid-state device, cloud storage or any other device capable of persistently storing information.

The processor 206 may include one or more microprocessors, micro-controllers, digital signal processors, microcomputers, central processing units (CPU), graphical processing units (GPU), tensor processing units (TPU), field programmable gate arrays, programmable logic devices, state machines, logic circuits, analog circuits, digital circuits, or any other devices that manipulate signals (analog or digital) based on computer-executable instructions residing in memory 202. The processor 206 also make use of a timer 212 to perform timing and counting operations, allowing the processor 206 to carry on with other processing while the timer 212 measures delay.

The processor 206 may be configured to read into memory 202 and execute computer-executable instructions residing in the non-volatile storage 204, such as those of the convection heating program 214. Upon execution by the processor 206, the computer-executable instructions may cause the oven 100 to implement one or more of the algorithms and/or methodologies disclosed herein.

The controller 200 may be electrically connected to signaling interfaces of other components of the oven 100, thereby allowing the processor 206 of the controller 200 to manipulate the functions of the oven 100. In an example, the controller 200 may be a component of the electronics board 152. The controller 200 may be configured to receive user input from user controls 208, such as requests to initiate a cooking or cleaning cycle. In one non-limiting example, the user controls 208 may be embedded in the door 104 of the oven 100. The controller 200 may also be configured to receive sensor input from the one or more sensors 162. For example, the infrared sensors 162 and/or camera sensors 162 may be arranged within the oven cavity 106 to allow for measurement of the temperature at different locations within the oven cavity 106. This may allow the controller 200 to identify areas in which the oven cavity 106 is cooler or warmer. In one example, the presence of a cold food item at one location within the oven cavity 106 may cause temperature readings closer to the food item to be cooler than temperature readings of other locations within the oven cavity 106.

The controller 200 may also be configured to control operation of the heating tubes 128, including to apply power to the heating tubes 128 to warm the oven cavity 106, as well as to discontinue applying power to the heating tubes 128 to discontinue heating of the oven cavity 106. It should be noted that the controller 200 may be able to control the operation of each of the heating tubes 128 independently. For instance, in the illustrated example the controller 200 may be configured to independently activate, deactivate, or change the power level being applied to each of the heating tubes 128A, 128B, 128C, and 128D.

To perform a cooking cycle, food is placed in the oven cavity 106 and the door 104 is closed. Responsive to selection of a cooking cycle from the user controls 208, the controller 200 may activate the heating tubes 128 to start generating heat and activate the fan 124 to generate the airflow. The fan 124 may accordingly rotate to generate a negative pressure in the oven cavity 106, thereby drawing air from the oven cavity 106 into the air channel 126. The air in the air channel 126 may be heated up by the heating tubes 128 and deflected back into the oven cavity 106. This air circulation may run continuously to reach and retain the oven cavity 106 at a set point center temperature. In some examples, depending on the cycle, the controller 200 may additionally activate the microwave components of the oven 100, such as the magnetron 142 and mode stirrer 146, to provide microwave energy into the oven cavity 106 to further cook the food items.

Once the food is heated, the controller 200 may deactivate the heating tubes 128, the fan 124, and/or the magnetron 142. The door 104 may be reopened and the food removed. The oven 100 may also include a door switch (not shown) that detects whether the door 104 is open or closed, such that the controller 200 may automatically deactivate the heating tubes 128, fan 124, and/or the magnetron 142 should the door switch indicate to the controller 200 that the door 104 was opened during a cooking cycle.

Figure 9:
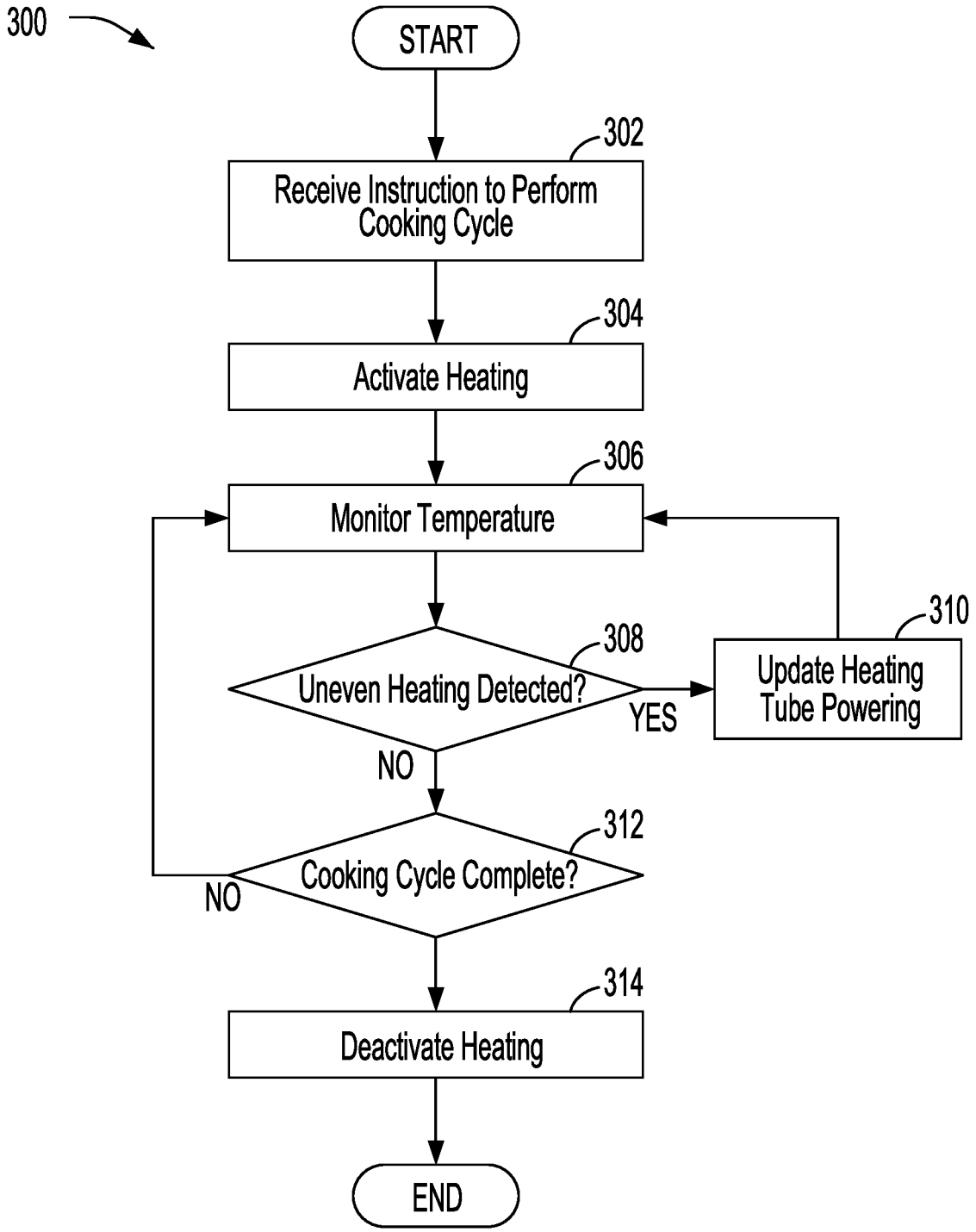
FIG. 9 illustrates an example process for utilizing the improved stereo convection circulation system to perform a cooking cycle.

FIG. 9 illustrates an example process 300 for utilizing the improved stereo convection circulation system to perform a cooking cycle. In an example, the process 300 may be performed by the oven 100 under the operation of the convection heating program 214 executed by the processor 206 of controller 200.

At operation 302, the oven 100 receives instruction to perform a cooking cycle. In an example, a user of the oven 100 may place a food item into the oven 100, close the door 104, and select to initiate a cooking cycle from the user controls 208. The cooking cycle may indicate one or more of a temperature to be maintained in the oven cavity 106 and an amount of time to heat the oven cavity 106. The cooking cycle may also define whether microwave energy should be providing during the cooking process.

At operation 304, the oven 100 instructs the heating systems to begin the cooking cycle. For example, responsive to receipt of the instruction to perform the cooking cycle, the controller 200 may activate the fan 124 and the heating tubes 128. The fan 124 may accordingly generate a stereo circulation of hot air inside the oven cavity 106. If applicable for the cycle, the controller 200 may additionally activate the microwave components of the oven 100, such as the magnetron 142 and mode stirrer 146, to provide microwave energy into the oven cavity 106 to further cook the food items. During the cooking cycle of the oven 100, a working mode of the heating tubes 128 and/or other heating elements of the oven 100 may be controlled individually and/or switched on/off at the same time to provide for even heat distribution in the oven cavity 106.

At operation 306, the oven 100 monitors heat distribution during the cooking cycle. In an example, the controller 200 may receive signals from the sensors 162. The sensors 162 may be arranged within the oven cavity 106 to allow for measurement of the temperature at different locations within the oven cavity 106.

At operation 308, the oven 100 determines whether uneven heating is detected. In an example, the controller 200 may utilize the signals from the sensors 162 to identify areas in which the oven cavity 106 is cooler or warmer. If uneven heating is detected, control passes to operation 310. Otherwise, control continues to operation 312.

At operation 310, the oven 100 adjusts the power to the heating tubes 128 to address the uneven heating. In an example, if the controller 200 determines that temperature is low adjacent to one or more of the heating tubes 128, the controller 200 may power or increase the power output to those heating tubes 128, thereby increasing temperature in that region of the oven 100. In another example, if the controller 200 determines that temperature is to high adjacent to one or more of the heating tubes 128, the controller 200 may decrease power to or discontinue power to those heating tubes 128, thereby decreasing temperature in that region of the oven 100. After operation 310, control returns to operation 308 to continue monitoring heating evenness.

At operation 312, the oven 100 determines whether the cooking cycle is complete. In an example, the controller 200 may utilize the timer 212 to determine if the time period for the cooking cycle has elapsed. In another example, the controller 200 may utilize other criteria to determine whether the cooking cycle is complete, such as appearance of the food item, temperature or humidity level in the oven cavity 106 etc. If the cooking cycle has completed, control passes to operation 314. If not, control returns to operation 306.

After operation 314, the oven 100 deactivates the heating systems. This may include deactivating the fan 124, heating tubes 128, and/or magnetron 142. The temperature in the oven cavity 106 may accordingly drop to ambient. In some examples, the oven 100 may instead control the fan 124 and/or heating tubes 128 to place the oven cavity 106 at a predefined warm temperature to keep the food warm until retrieved. After operation 314, the process 300 ends.

Thus, the improved forced convection system for the oven 100 may be integrated into a chamber above and to the sides of the oven cavity 106, thereby avoiding the rear compartment in traditional forced convection systems. The system may include air outlets 130 from different directions, including top front, top back, left, and right. The system may also include heating tubes 128 or other heating elements at the top front, top back, left, and right inlet locations. Using the air outlets 130 and heating tubes 128, the system may generate a stereo circulation of hot air inside the oven cavity 106. During operation, a working mode of the heating tubes 128 or other heating elements may be controlled individually and/or switched on/off at the same time to provide for even heat distribution in the oven cavity 106.

All terms used in the claims are intended to be given their broadest reasonable constructions and their ordinary meanings as understood by those knowledgeable in the technologies described herein unless an explicit indication to the contrary in made herein. In particular, use of the singular articles such as "a," "the," "said," etc. should be read to recite one or more of the indicated elements unless a claim recites an explicit limitation to the contrary.

The abstract of the disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A convection oven, comprising:

an oven cavity defined by at least by a top wall, a left side wall, a right side wall, and a door configured selectively open and close the oven cavity; and an air channel defining a convection airflow out of and back into the oven cavity, the top wall defining an air inlet to allow the convection airflow to enter the air channel from the oven cavity, the walls further defining a plurality of outlets to allow the convection airflow to exit the air channel and reenter the oven cavity, each of the plurality of outlets defining an elongate recess having a semi-annular surface, the recess extending into the air channel away from the oven cavity such that the recess is inset into the air channel, the plurality of outlets including a first outlet along the left side wall and a second outlet along the right side wall thereby providing a stereo circulation pattern, and at least one outlet along the top wall, wherein each of the plurality of outlets houses a corresponding one of a plurality of heating tubes, each corresponding heating tube being axially mounted within a correspondence recess along the airflow exiting the air channel.

2. The convection oven of claim 1, wherein a lateral concave face of the recess defines a vent hole pattern, between the air channel and the recess, opening to the oven cavity.

3. The convection oven of claim 2, wherein side walls of the outlets define apertures through which the corresponding heating tube are mountable.

4. The convection oven of claim 1, wherein the semi-annular surface of the recess smoothly defects the airflow over and around the corresponding heating tube with a minimum of turbulence.

5. The convection oven of claim 1, wherein the corresponding heating tube is a quartz tube heater, a halogen-radiation source heater, an IR-radiating heater, or a resistive element.

6. The convection oven of claim 1, wherein the at least one outlet along the top wall includes a third outlet along a front portion of the top wall and a fourth outlet along a rear portion of the top wall.

7. The convection oven of claim 6, wherein the first outlet and the second outlet each longitudinally extend from front to back of the oven cavity, and the third and fourth outlets each longitudinally extend side to side along the oven cavity.

8. The convection oven of claim 1, wherein the air inlet is located centrally in the top wall and a fan is located centrally and above the air inlet, such that when activated, the fan drives the airflow into the air channel via the air inlet and out of the air channel via the outlets.

9. The convection oven of claim 8, further comprising a controller configured to:

activate the fan and the plurality of heating tubes responsive to instruction to perform a cooking cycle; and deactivate the fan and the plurality of heating tubes responsive to completion of the cooking cycle.

10. The convection oven of claim 9, further comprising a plurality of sensors arranged within the oven cavity, wherein the controller is further configured to:

monitor temperature within the oven cavity using signals received from the plurality of sensors;

responsive to determining that the temperature is too low adjacent to one or more of the heating tubes for the cooking cycle, power or increase power to those heating tubes, thereby increasing the temperature in that region of the convection oven; and responsive to determining that the temperature is too high adjacent to one or more of the heating tubes for the cooking cycle, remove power or decrease power to those heating tubes, thereby decreasing the temperature in that region of the convection oven.

11. The convection oven of claim 10 wherein the plurality of sensors includes one or more of a camera sensor or an infrared sensor.

12. The convection oven of claim 9, further comprising a magnetron, wherein the controller is further configured to:

activate the magnetron in combination with the heating tubes responsive to instruction to perform a cooking cycle; and deactivate the magnetron responsive to completion of the cooking cycle.

13. A method for utilizing a forced convection oven, comprising:

monitoring temperature within an oven cavity using signals received from a plurality of temperature sensors within the oven cavity, the oven cavity being defined by at least by a top wall, a left side wall, a right side wall, and a door configured selectively open and close the oven cavity, the convection oven including an air channel defining a convection airflow out of and back into the oven cavity, the top wall defining an air inlet to allow the convection airflow to enter the air channel from the oven cavity, the walls further defining a plurality of outlets to allow the convection airflow to exit the air channel and reenter the oven cavity, each of the plurality of outlets defining an elongate recess having a semi-annular surface, the recess extending into the air channel away from the oven cavity such that the recess is inset into the air channel, the plurality of outlets including a first outlet along the left side wall and a second outlet along the right side wall thereby providing a stereo circulation pattern, and at least one outlet along the top wall, wherein each of the plurality of outlets houses a corresponding one of a plurality of heating tubes, each of the plurality of heating tubes being mounted along the convection airflow exiting the air channel, the air inlet being located centrally in the top wall, a fan being located centrally and above the air inlet, such that when activated, the fan drives the convection airflow into the air channel via the air inlet and out of the air channel via the outlets;

responsive to determining that the temperature is too low adjacent to one or more of the heating tubes for a cooking cycle, powering or increasing power to those heating tubes, thereby increasing the temperature in that region of the convection oven; and responsive to determining that the temperature is too high adjacent to one or more of the heating tubes for the cooking cycle, removing power or decreasing power to those heating tubes, thereby decreasing the temperature in that region of the convection oven.

14. The method of claim 13, further comprising:

receiving an indication to begin the cooking cycle via input to user controls of the convection oven;

activating the fan and the plurality of heating tubes responsive to instruction to perform the cooking cycle; and deactivating the fan and the plurality of heating tubes responsive to completion of the cooking cycle.

15. The method of claim 14, further comprising:

activating a magnetron in combination with the heating tubes responsive to instruction to perform a cooking cycle; and deactivating the magnetron responsive to completion of the cooking cycle.

* * * * *